US012196451B2

(12) United States Patent
Wirth

(10) Patent No.: US 12,196,451 B2
(45) Date of Patent: Jan. 14, 2025

(54) ACTIVE AIRFLOW INHIBITING APPARATUS

(71) Applicant: Wirth Doors Limited, Bicester (GB)

(72) Inventor: Nicholas J. P. Wirth, Northamptonshire (GB)

(73) Assignee: Wirth Doors Limited, Bicester (GB)

( * ) Notice: Subject to any disclaimer, the term of this patent is extended or adjusted under 35 U.S.C. 154(b) by 565 days.

(21) Appl. No.: 16/970,048

(22) PCT Filed: Feb. 18, 2019

(86) PCT No.: PCT/GB2019/050418
§ 371 (c)(1),
(2) Date: Aug. 14, 2020

(87) PCT Pub. No.: WO2019/158938
PCT Pub. Date: Aug. 22, 2019

(65) Prior Publication Data

US 2021/0095873 A1 Apr. 1, 2021

(30) Foreign Application Priority Data

Feb. 16, 2018 (GB) ..... 1802606

(51) Int. Cl.
*F24F 9/00* (2006.01)
*F24F 11/30* (2018.01)
(Continued)

(52) U.S. Cl.
CPC ..... *F24F 9/00* (2013.01); *F24F 11/30* (2018.01); *F24F 2009/005* (2013.01);
(Continued)

(58) Field of Classification Search
CPC .... F24F 9/00; F24F 11/30; F24F 11/89; F24F 2009/005; F24F 2110/10; F24F 2110/40;
(Continued)

(56) References Cited

U.S. PATENT DOCUMENTS 6,532,761 B2 * 3/2003 Murakami ..... F25D 15/00 62/426
2003/0221821 A1 * 12/2003 Patel ..... F24F 11/63 165/290

(Continued)

FOREIGN PATENT DOCUMENTS

CA 2316468 A1 2/2001
CA 2908917 A1 4/2017

(Continued)

OTHER PUBLICATIONS

Saudi Authority for Intellectual Property Substantive Examination Report, Application No. 520412655, dated Jan. 19, 2022.

(Continued)

*Primary Examiner* — Steven B McaAllister
*Assistant Examiner* — Charles R Brawner
(74) *Attorney, Agent, or Firm* — Honigman LLP; John Chau; Jonathan P. O'Brien

(57) ABSTRACT

An active airflow inhibiting apparatus for an entranceway comprises a structure, an airflow sensor, and a controller. The structure comprises one or more air mover devices configured to be positioned adjacent an entranceway of a building and defining a passage therethrough for accessing the entranceway. The airflow sensor is configured to provide an output indicative of speed and direction of airflow through the entranceway or at the air mover devices. The controller is connected to the air mover devices and the airflow sensor. The controller is configured to receive the output of the airflow sensor and to control an output of the air mover devices based on the received output so as to generate a differential pressure across the air mover devices which inhibits airflow through the entranceway.

15 Claims, 10 Drawing Sheets

(51) Int. Cl.
*F24F 11/89* (2018.01)
*F24F 110/10* (2018.01)
*F24F 110/32* (2018.01)
*F24F 110/40* (2018.01)

(52) U.S. Cl.
CPC ..... *F24F 11/89* (2018.01); *F24F 2110/10* (2018.01); *F24F 2110/32* (2018.01); *F24F 2110/40* (2018.01)

(58) Field of Classification Search
CPC ..... F24F 2221/28; F24F 2221/46; F24F 2221/52; F24F 13/26; F24F 1/01; E06B 7/00
USPC ..... 454/188
See application file for complete search history.

(56) References Cited

U.S. PATENT DOCUMENTS

| | | | | |
|---|---|---|---|---|
| 2009/0291627 | A1* | 11/2009 | Zimmermann | F24F 9/00 700/275 |
| 2014/0255173 | A1* | 9/2014 | Poulton | F04D 25/08 415/182.1 |

FOREIGN PATENT DOCUMENTS

| | | | | | |
|---|---|---|---|---|---|
| CN | 2460903 | Y | | 11/2001 | |
| CN | 101460784 | A | | 6/2009 | |
| CN | 101828081 | A | | 9/2010 | |
| CN | 105928165 | A | | 9/2016 | |
| CN | 205842946 | U | | 12/2016 | |
| CN | 106403138 | A | | 2/2017 | |
| DE | 590879 | C | | 1/1934 | |
| DE | 86684 | A | | 12/1974 | |
| DE | 102009026949 | A1 | | 12/2010 | |
| EP | 0 900 990 | A2 | * | 4/1998 | F24F 9/00 |
| EP | 0900990 | A1 | * | 3/1999 | F24F 9/00 |
| EP | 1342959 | A1 | | 9/2003 | |
| GB | 2026682 | A | | 2/1980 | |
| JP | S4880331 | U | | 10/1973 | |
| JP | S5541335 | A | | 3/1980 | |
| JP | S60223937 | A | | 11/1985 | |
| JP | S6124936 | A | | 2/1986 | |
| JP | H0814622 | A | | 1/1996 | |
| JP | H0875206 | A | | 3/1996 | |
| JP | 2006254464 | A | | 9/2006 | |
| KR | 10-2012-0132857 | A | | 12/2012 | |
| KR | 2012 0132857 | | * | 12/2012 | F24F 9/00 |
| KR | 20120132857 | A | * | 12/2012 | F24F 9/00 |
| WO | WO-9849499 | A1 | | 11/1998 | |
| WO | WO-2008115629 | A1 | | 9/2008 | |
| WO | WO-2013084192 | A1 | | 6/2013 | |

OTHER PUBLICATIONS

First Chinese Office Action, Application No. 2019800256979, dated May 20, 2021.
Written Opinion of the Intellectual Property Office of Singapore, Application No. 11202007800R, dated Mar. 26, 2021.
UK Search Report for Application No. GB1802606.2 dated Mar. 29, 2018.
UK Search Report for Application No. GB1818185.9 dated Dec. 14, 2018.
Int'l Search Report and Written Opinion for Application No. PCT/GB2019/050418 dated Sep. 12, 2019.
First Examination Report, Australian Application No. 2019221812, dated Sep. 25, 2023.
Examination Report for Mexican Patent Application MX/a/2020/008594, Mar. 14, 2024.

* cited by examiner

ACTIVE AIRFLOW INHIBITING APPARATUS

CROSS REFERENCE TO RELATED APPLICATION

This U.S. patent application claims priority under 35 U.S.C. § 371 to Patent Cooperation Treaty Application No. PCT/GB2019/050418, filed on Feb. 18, 2019, which claims the benefit of earlier-filed Great Britain Application No. GB1802606.2, filed on Feb. 16, 2018. The disclosures of these prior applications are considered part of the disclosure of this application and are hereby incorporated by reference in their entireties.

TECHNICAL FIELD

The invention relates to an active airflow inhibiting apparatus for an entranceway, and particularly a doorway.

BACKGROUND

Various styles of doors are used at the entrances of retail spaces, such as shopping centers (malls), supermarkets or other stores.

A common style of door is the automatic sliding door. Two sets of automatic sliding doors are often provided in series to form a draught lobby which acts as an airlock to prevent wind from entering the building. However, in high traffic areas, it is common for both sets of doors to be open at the same time, thus providing a direct path for air to pass through the door. This can lead to unpleasant draughts. In addition, airflow may occur through a door as a result of temperature differentials across the door. Airflow through a door (whether from draughts or induced by temperature differentials) increases the power output requirements of HVAC systems within the building.

Over door heaters are often used to try to mask the incoming draught to improve customer experience. However, these devices consume large amounts of energy and do not address the problem itself. Another option is to provide an air curtain across the doorway. However, these devices are not able to prevent infiltration where there is a large pressure differential or under windy conditions.

Experience has shown that any physical barrier, even an automatically opening door, can lead to a reduction in the number of people entering a store and that stores have started keeping the doors open throughout all of the working hours to minimize this effect. In this case, the energy costs through the passage of heated or cooled air out of the building and replaced by ambient air can be substantial.

It is therefore desirable to provide an airflow inhibiting apparatus which addresses the disadvantages of existing solutions.

SUMMARY

In accordance with an aspect of the invention, there is provided an active airflow inhibiting apparatus for an entranceway comprising: a structure comprising one or more air mover devices configured to be positioned adjacent an entranceway of a building and defining a passage therethrough for accessing the entranceway; an airflow sensor configured to provide an output indicative of speed and direction of airflow through the entranceway or at the one or more air mover devices; and a controller connected to the one or more air mover devices and the airflow sensor;

wherein the controller is configured to receive the output of the airflow sensor and to control an output of the one or more air mover devices based on the received output so as to generate a differential pressure across the one or more air mover devices which inhibits (i.e. minimizes or prevents) airflow through the entranceway.

The one or more air mover devices may form an archway.

The one or more air mover devices may be air multiplier devices.

The one or more air mover devices may comprise a plurality of air mover devices and the plurality of air mover devices may form a plurality of arches (or a pair of uprights).

The plurality of arches may be nested within one another in a single plane.

The plurality of arches may be arranged side by side (i.e. in series).

The one or more air mover devices may be configured to generate an area of negative pressure which entrains the airflow and/or an area of positive pressure which repels the airflow.

The apparatus may comprise a plurality of said structures and each of the plurality of said structures may be configured to be positioned adjacent a different entranceway of the same building.

The controller may be configured to synchronize the operation of the air mover devices with the opening of a door of the entranceway based on the output of an activation sensor.

The activation sensor may be located within the passage defined by the structure.

The array of air mover devices may be configured to be located externally to the entranceway.

The air mover devices may be bidirectional.

The airflow sensor may be configured to provide an output indicative of speed and direction of airflow through the entranceway at a plurality of vertical positions through the entranceway.

The airflow sensor may comprise a plurality of sensor elements located at different vertical positions.

The controller may be configured to determine an optimized set of outputs for the plurality of structures. The controller may be configured to determine a set of outputs for the one or more air mover devices of the plurality of structures which are dependent on one another.

The controller may be configured to control the output of the air mover devices so as to generate a differential pressure which varies with vertical position.

The air mover devices may comprise a plurality of air mover devices which are spaced around a common circle to generate a vortical airflow.

The plurality of air mover devices may be arranged so that their airflow axes lie tangential to the common circle.

In accordance with an aspect of the invention, there is provided an air multiplier device comprising: an air inlet; a pair of first air outlets and a pair of second air outlets, wherein the pair of first air outlets are located on opposing sides of the air multiplier device and the pair of second air outlets are located on opposing sides of the air multiplier device and wherein the pair of first air outlets and the pair of second air outlets are arranged in a back-to-back relationship such that they face in opposite directions; a pump for passing air from the air inlet to the pair of first air outlets and the pair of second air outlets; wherein the device has a first configuration in which the air from the air inlet is directed to the pair of first air outlets and a second configuration in which the air from the air inlet is directed to the pair of second air outlets and wherein the device is configured to operate in one of the first and second configurations to allow bidirectional airflow.

BRIEF DESCRIPTION OF THE DRAWINGS

For a better understanding of the invention, and to show more clearly how it may be carried into effect, reference will now be made, by way of example, to the accompanying drawings, in which:—

DETAILED DESCRIPTION

Figure 1:
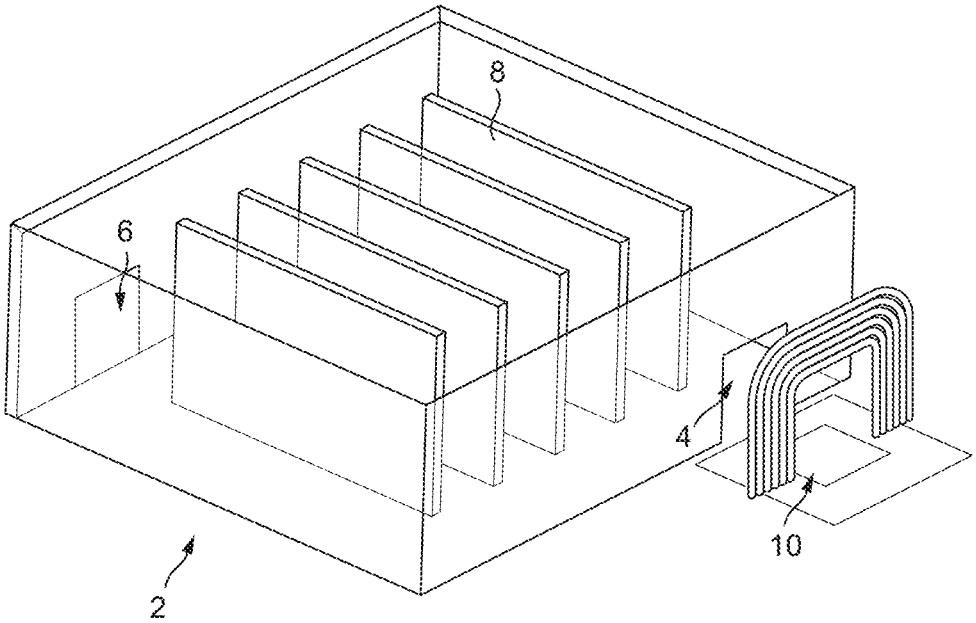
FIG. 1 is a model of a store building having an airflow inhibiting apparatus according to an embodiment of the invention.

FIG. 1 shows a simplified model of a store building 2, such as a supermarket or other retail space. As shown, in this example, the building 2 has a front entrance 4 and a rear entrance 6. The front and rear entrances 4, 6 are shown as open doorways to signify that a door located at the entrance is in an open position and so not covering the doorway. In particular, the front and rear entrances 4, 6 may utilize automatic sliding doors and so the model shown in FIG. 1 represents where customers are passing simultaneously through the front and rear entrances 4, 6.

Internally, the space within the building 2 is divided into a number of aisles by dividers 8.

Figure 2:
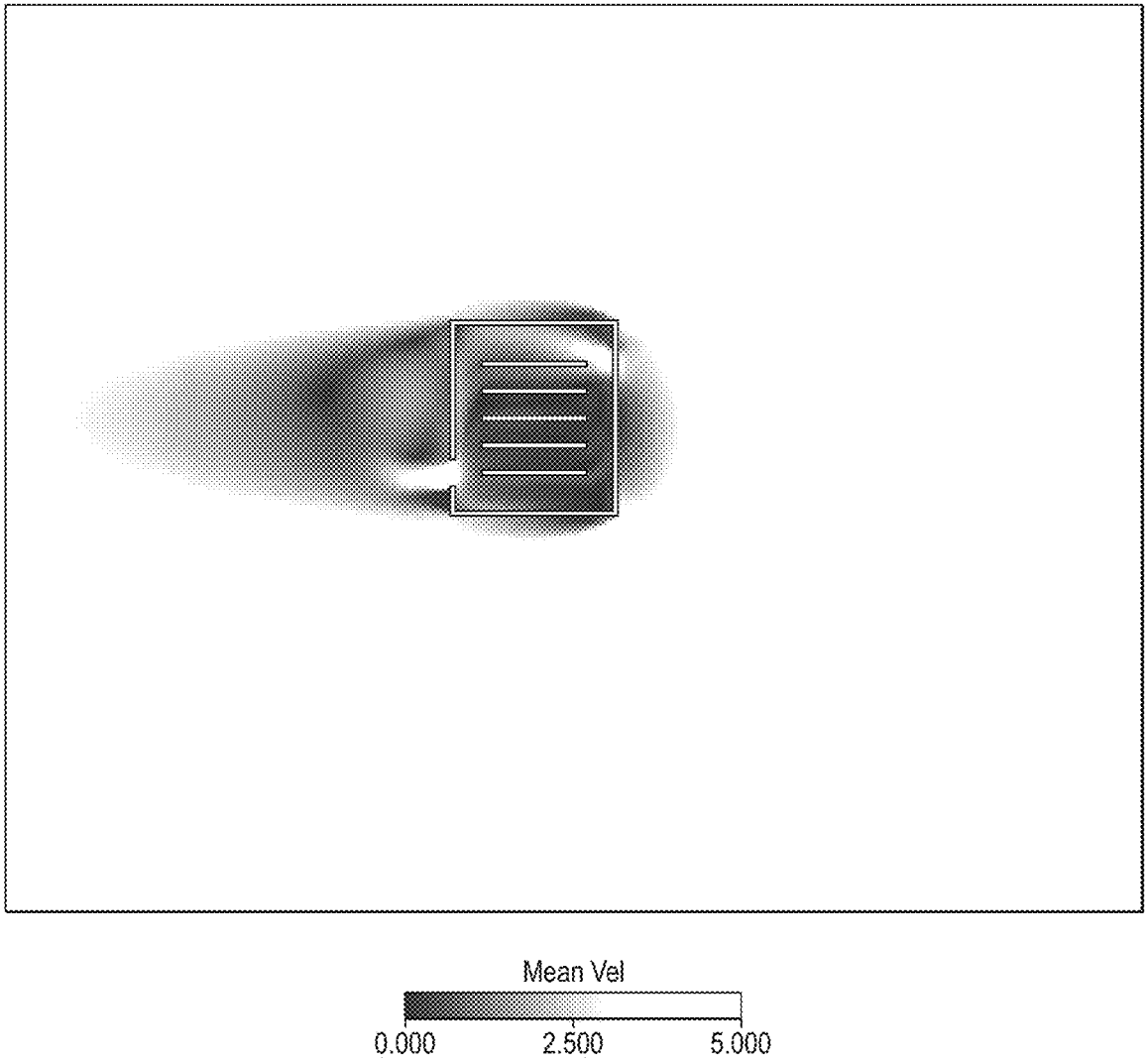
FIG. 2 is an airflow velocity plot over a plan view of the store building showing airflow around and through the building without the airflow inhibiting apparatus in place.
Figure 3:
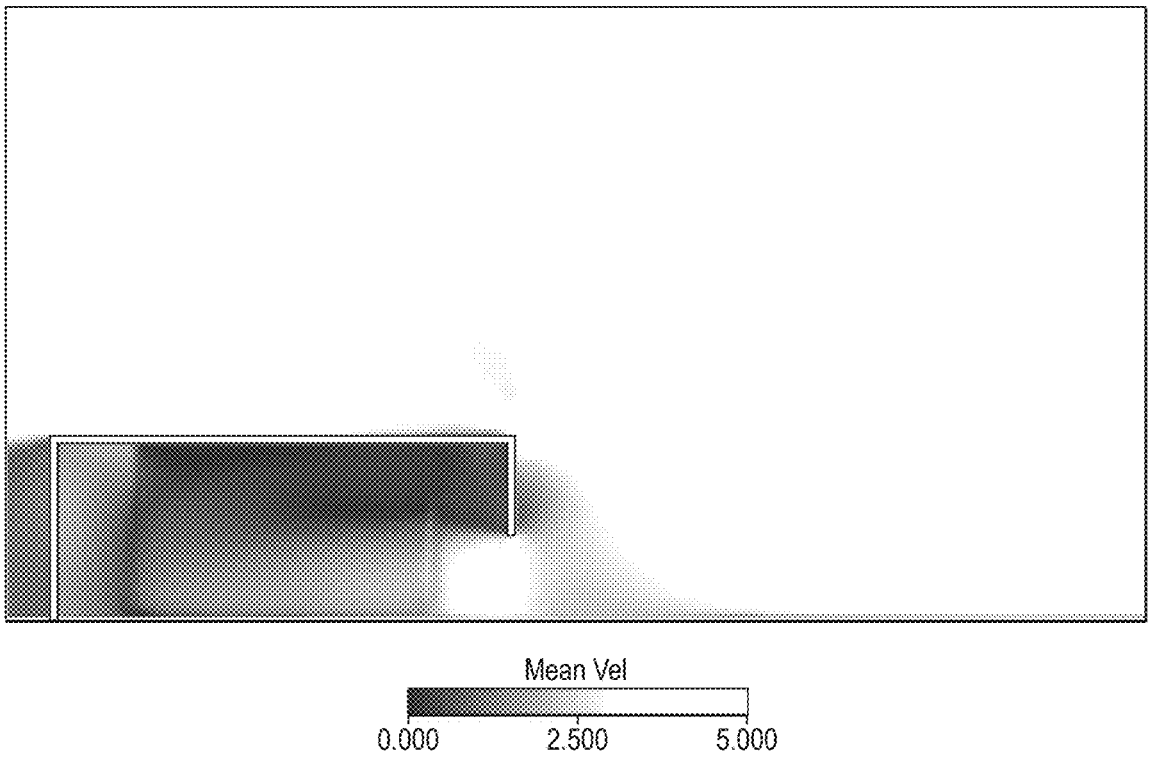
FIG. 3 is an airflow velocity plot over a cross-sectional side view through a front entrance of the store building showing airflow passing into the building via the front entrance.
Figure 4:
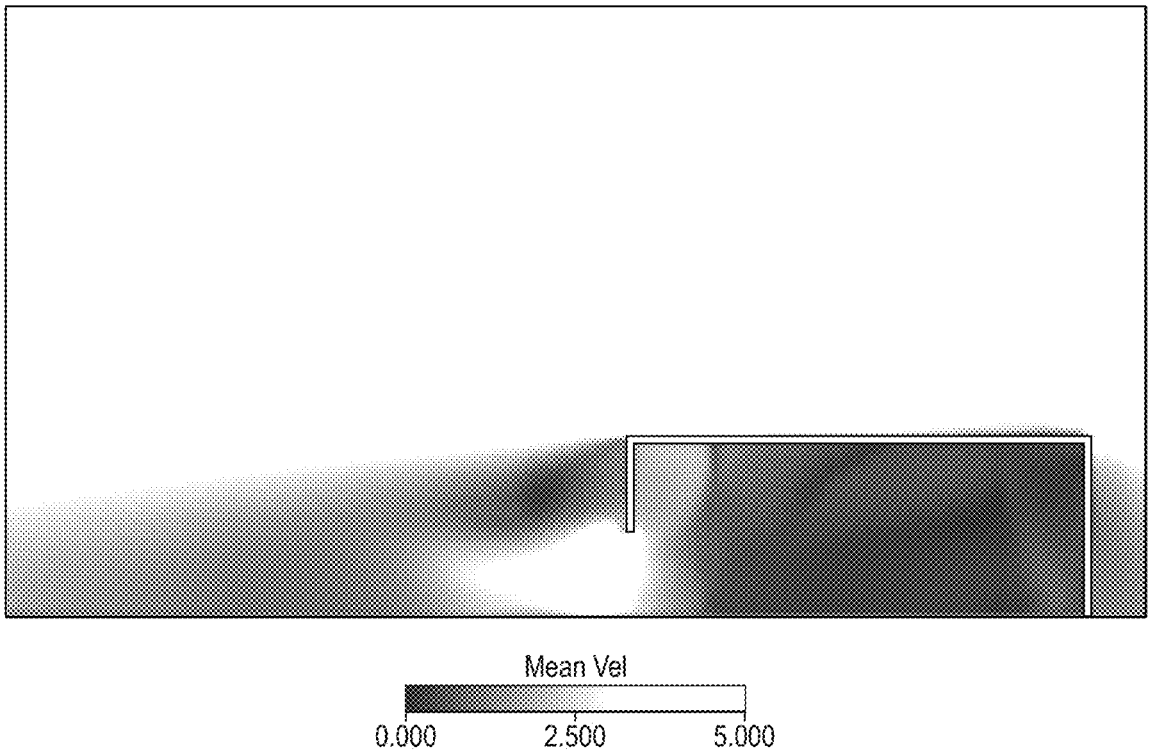
FIG. 4 is an airflow velocity plot over a cross-sectional side view through a rear entrance of the store building showing airflow exiting the building via the rear entrance.

As shown in FIGS. 2 to 4, with wind directed towards the front entrance 4, air is allowed to flow into the building 2 via the front entrance 4 and is drawn through the building 2, predominantly through the aisles closest to the front entrance 4, before exiting the building 2 via the rear entrance 6. A strong current of air (draught) is therefore generated through the interior of the building 2. This may be unpleasant for customers and employees located within the building 2.

As shown in FIG. 1, an airflow inhibiting apparatus 10 is provided adjacent the front entrance 4 which seeks to reduce or eradicate entirely such draughts through the building.

Figure 5:
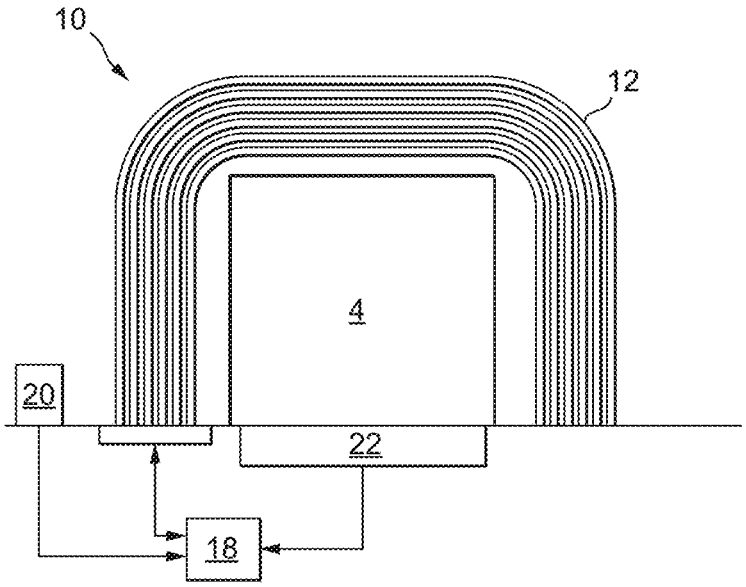
FIG. 5 is a front view of the airflow inhibiting apparatus.

As shown in FIG. 5, the airflow inhibiting apparatus 10 comprises a structure formed by an array of air mover devices 12.

Each of the air mover devices 12 generally is in the form of an arch (6 arches are shown, but any number may be used, including a single arch formed potentially by only one air mover device). The dimensions of each arch differ such that the air mover devices 12 are nested in a single plane with each subsequent air mover device 12 surrounding a smaller air mover device 12 of the array. The innermost air mover device 12 has dimensions which are slightly greater than the doorway of the front entrance 4, as shown in FIG. 5, such that it does not impede the doorway.

The array of air mover devices 12 thus form an archway. This archway sits adjacent to the front entrance 4 but spaced externally therefrom (by approximately 1 to 2 m), as shown in FIG. 1.

Figure 6:
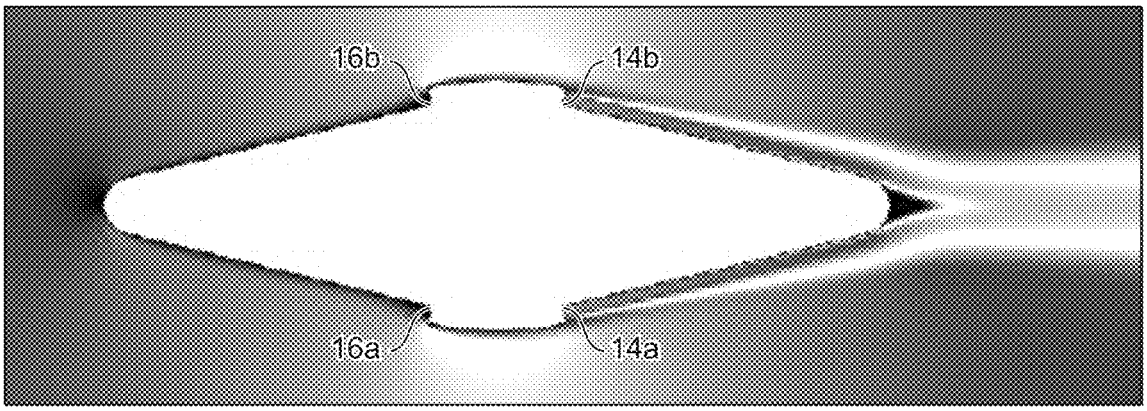
FIG. 6 is a cross-section through an air mover device of the airflow inhibiting apparatus.

Each of the air mover devices 12 is a bidirectional air multiplier. As shown in FIG. 6, the air mover devices 12 have a substantially rhombus like (e.g. lozenge shaped) cross-section. They may instead have an oval, symmetric lens or similar cross-section.

The air mover devices 12 comprise a pair of outward facing outlets 14*a*, 14*b* and a pair of inward facing outlets 16*a*, 16*b*. The pair of outward facing outlets 14*a*, 14*b* are located on opposing sides of the air mover device 12 and the pair of inward facing outlets 16*a*, 16*b* are located on opposing sides of the air mover device 12. The pair of outward facing outlets 14*a*, 14*b* and the pair of inward facing outlets 16*a*, 16*b* are arranged in a back-to-back relationship such that they face in opposite directions.

In a first mode of operation, a jet of air (from an impeller or other pump, for example) is ejected from each of the outward facing outlets 14*a*, 14*b* and passes along the opposing and converging surfaces of the air mover device 12. This jet of air creates an area of negative pressure which draws additional air into the airflow from between the air mover device 12 and the front entrance 4. Further, as the air moves away from the air mover device 12 it entrains additional air within the airflow. The volume of air within the airflow is thus multiplied. In a second mode of operation, the air mover devices 12 operate in the reverse manner with air being ejected from the inward facing outlets 16*a*, 16*b*. The selection of the first and second modes of operation may be controlled by an internal controller of the air mover device 12.

The array of air mover devices 12 is connected (either via a wired or wireless connection) to a controller 18 which is in turn connected (again, either via a wired or wireless connection) to an airflow sensor 20 and an activation sensor 22.

The activation sensor 22 may be a pressure sensor or a movement sensor (such as a passive infra-red sensor or the like) which provides a signal that indicates when someone passes through the archway of air mover devices 12 prior to entering the building 2 via the front entrance 4.

The airflow sensor 20 provides an output which is indicative of the present wind conditions, particularly the wind speed and direction.

Figure 7:
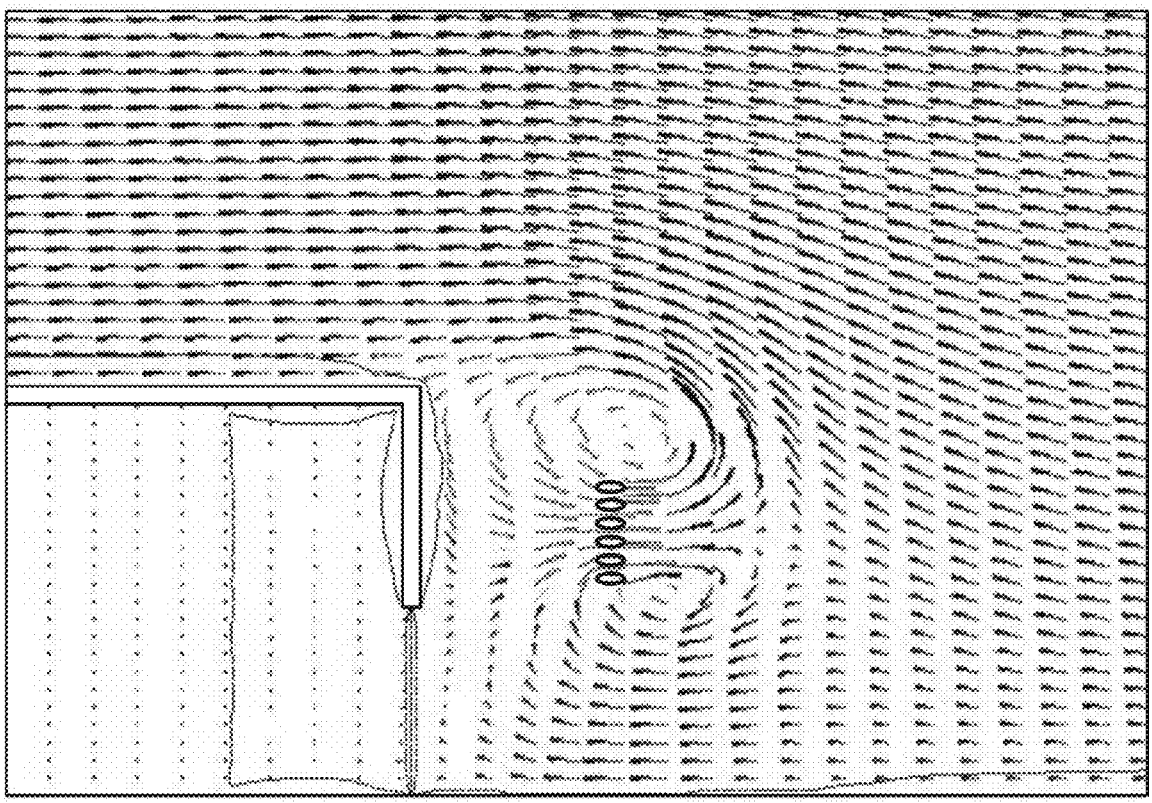
FIG. 7 is a cross-sectional side view through the front entrance of the store building showing flow vectors produced when the airflow inhibiting apparatus is in operation.
Figure 8:
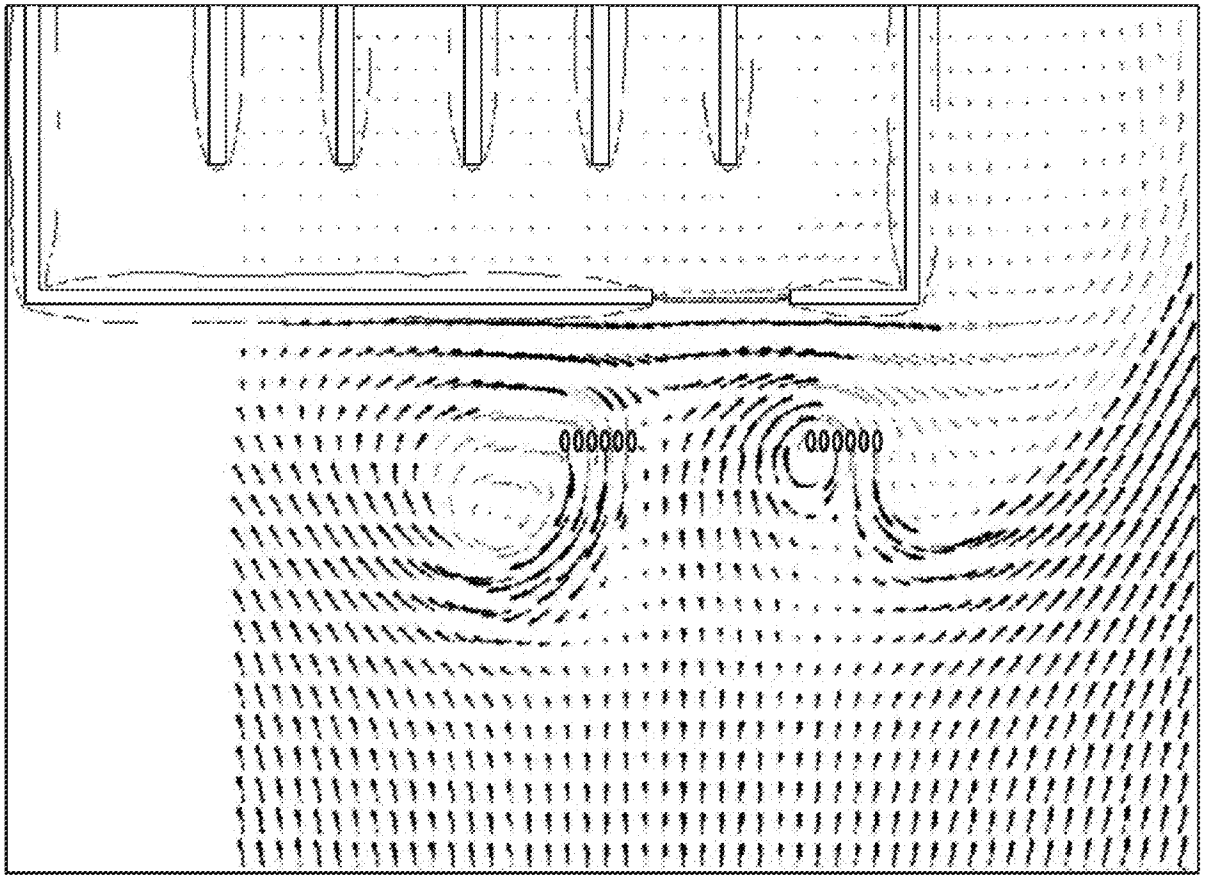
FIG. 8 is a plan view of the store building showing flow vectors produced when the airflow inhibiting apparatus is in operation.

The controller 18 receives as inputs the signals from the activation sensor 22 and the airflow sensor 20. The controller 18 uses these signals to control the operation of the air mover devices 12. Specifically, the controller 18 sets a fan speed setting of the air mover devices 12 based on the speed and direction of the wind. The fan speed setting is set to create a pressure differential which opposes the approaching wind and is sufficient to cause it to be substantially stopped, redirected or reversed. For example, as shown in FIGS. 7 and 8, on passing through the archway of air mover devices 12, the wind is drawn upwards and outwards and forms part of the airflow of the air mover devices 12 (either passing directly through the air mover devices 12 or being entrained with this airflow), or at least is drawn away from the door. The wind is therefore prevented from entering the doorway of the front entrance 4. The fan speed setting can be controlled based on the speed and direction of the wind to ensure that the air mover devices 12 have sufficient power to prevent the wind from entering the building 2.

The operation of the air mover devices 12 is also coordinated based on the signals of the activation sensor 22. Specifically, the air mover devices 12 may only be switched on or operated at the required fan speed (differential pressure) setting when someone is approaching the front entrance and the door will open allowing a draft to be formed. A corresponding sensor may be provided inside the building 2 to indicate when the door will be triggered by someone leaving the building 2.

If the wind direction were reversed such that air entered the rear entrance 6 of the building and exited the front entrance 4, the air mover devices 12 would be operated in the opposite configuration forcing air towards the front entrance 4 from the inward facing outlets 16*a*, 16*b*. Blocking the escape route for wind entering the rear entrance 6 similarly prevents draughts from forming.

The controller 18 is able to actively manage the operation of the air mover devices 12 to prevent or minimize draughts at all times, regardless of the current wind conditions. The controller 18 may access a look-up table or other reference source to determine the correct setting for the current wind conditions.

In other examples, the airflow inhibiting apparatus 10 may comprise a plurality of arrays of air mover devices 12 which are provided at each doorway of the building. The airflow inhibiting apparatus 10 may comprise a single controller 18 which is in communication with each of the arrays and is able to make local adjustments to prevent airflow either into or out of the respective doorways. The effect of each of the arrays has an impact on the other arrays and so the settings for the arrays cannot be determined in isolation. Consequently, the controller 18 determines a set of outputs for the plurality of arrays which are dependent on one another. In particular, the controller 18 may perform a multivariate analysis (or other analysis) which seeks to define the optimum overall solution (particularly, with the minimum energy usage).

Although the airflow inhibiting apparatus 10 has been described in relation to airflows generated by wind, it will be appreciated that it may also minimize or prevent airflows associated with temperature differentials at a doorway (i.e. in the absence of any wind or draught). Such temperature differentials lead to both ingress and egress at the doorway as a result of buoyancy effects. Specifically, higher density, colder air flows in one direction at the lower part of the door plane and lower density, warmer air flows in the opposite direction at the upper part of the door plane in order to maintain net building pressure.

In such circumstances, the airflow sensor 20 is able to determine the current airflow through the doorway at a plurality of vertical positions (for example, by utilizing a plurality of sensor elements located at different vertical positions). The controller 18 is able to utilize the output of the airflow sensor 20 to control the individual output of the air mover devices 12 to vary with vertical position. Specifically, the air mover devices 12 are able to generate a stratified differential pressure which provides a negative pressure over part of the doorway and a positive pressure over another part of the same doorway in order to counteract the opposing flows through the doorway generated by buoyancy effects.

The fan speed settings of the air mover devices 12 may also vary vertically and/or horizontally within a single array, while all generating a positive or negative pressure, to taken into account variations in wind conditions and directions.

Figure 9:
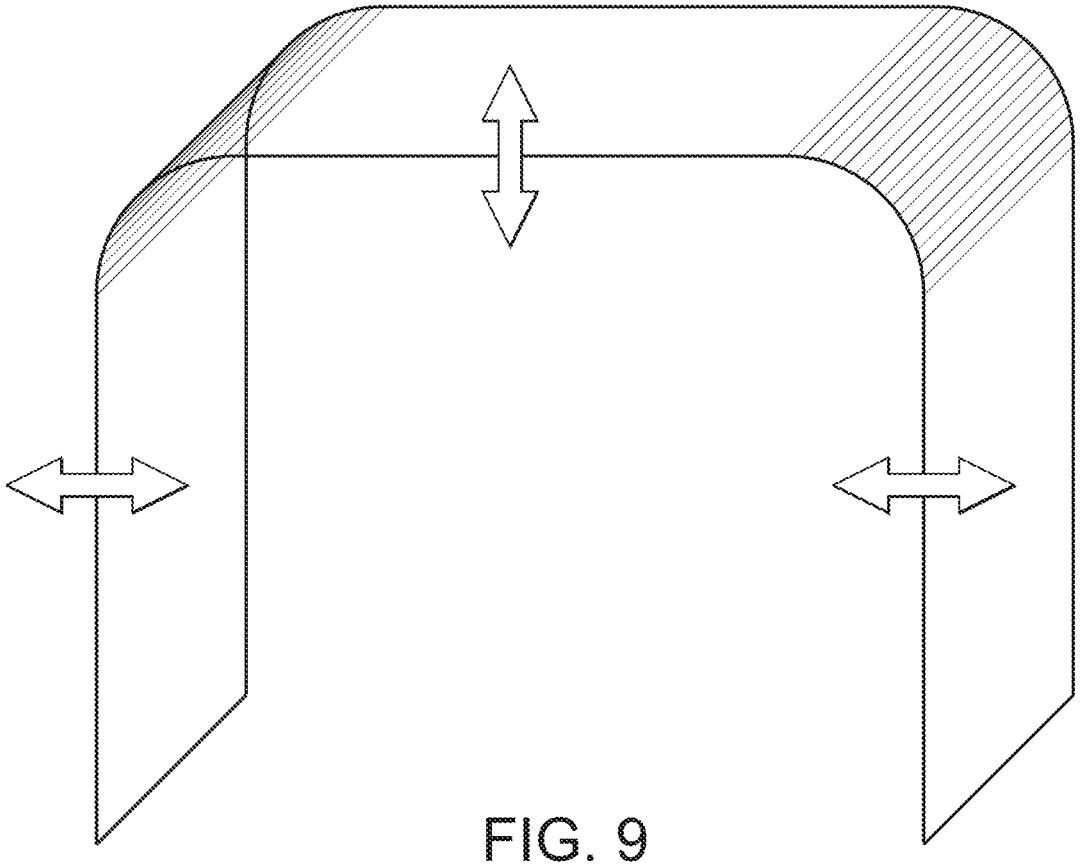
FIG. 9 is a schematic view of an air mover array according to another embodiment of the invention.

As shown in FIG. 9, the air mover devices 12 may be rotated by 90 degrees such that the airflow is directed either radially inward or radially outward through the archway and thus the airflow is along a plane which is parallel to the plane of the doorway (a transverse direction). Such an archway may be formed by a plurality of identical arches located in series. In other examples, the air mover devices 12 may be angled in between these two extremes to form a conical arch.

Figure 10:
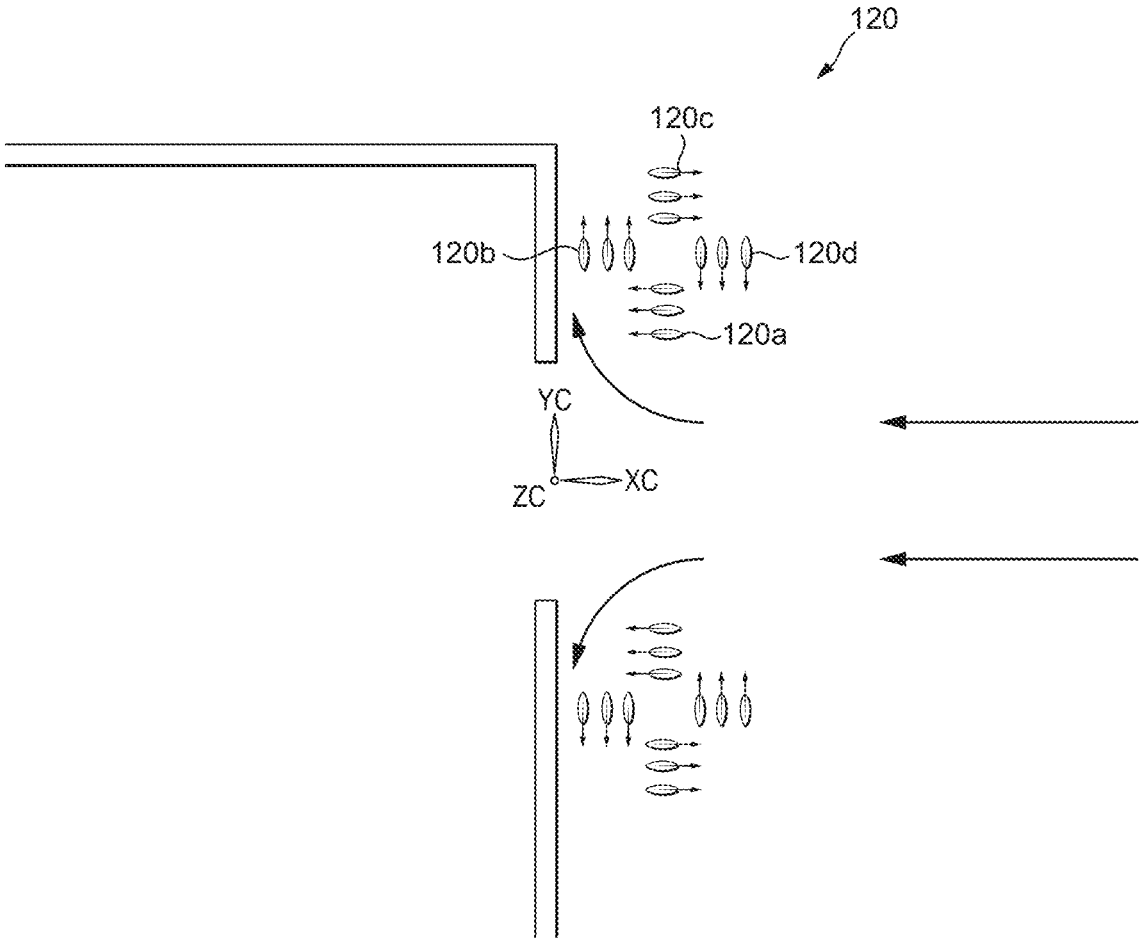
FIG. 10 is a plan view of an air mover array according to another embodiment of the invention.

FIG. 10 shows an alternative arrangement of air mover devices 120. As shown, the air mover devices 120 are arranged either side of the doorway in four groups 120*a*, 120*b*, 120*c*, 120*d*. Each of the groups 120*a*-120*d* comprises a plurality of air mover devices 120 (three are shown). The air mover devices 120 within each group 120*a*-120*d* are arranged parallel to one another. Each group 120*a*-120*d* is arranged so that its airflow axis (i.e. the direction along which it drives airflow) lies tangential to a common circle (with the individual air mover devices 120 having their airflow axes arranged on a plurality of concentric circles) such that the groups are positioned at 0, 90, 180 and 270 degrees. The opposing groups 120*a*, 120*c* and 120*b*, 120*d* are configured so that they generate airflow in opposing directions. Specifically, the group 120*a* drives air towards the doorway, whereas the group 120*c* drives air away from the doorway; and the group 120*b* drives air transversely away from the doorway, whereas the group 120*d* drivers air transversely towards the doorway.

The air mover devices 120 are therefore able to create a circulating (vortical) flow either side of the doorway which draws away airflow which is approaching the doorway in a transverse direction.

It will be appreciated that the number of groups of air mover devices 120 is not limited to four and the air mover devices 120 could instead be arranged as 3 or more groups. Further, each group may contain any number of air mover devices 120.

The groups 120*a*-120*d* may be formed as arches in a similar manner to the examples described above. Accordingly, the air mover devices 120 may also extend horizontally and draw airflow upwards and away from the doorway.

Although the air mover devices 12, 120 have been described as being air multipliers, it will be appreciated that other forms of the air mover devices, such as conventional bladed fans, may be used.

The front of the building may comprise a recess (for example, being dished inwardly), with the doorway being positioned within the recess so that it is set back from the boundary of the building. This arrangement may allow the air mover devices 12 to be sited within or at the boundary of the building (although still external to the doorway).

The preceding description describes how the output of the air mover devices 12, 120 is controlled by adjusting a fan speed setting. In other arrangements, the output of the air mover devices 12, 120 may be adjusted in other manners. For example, the output may be adjusted by controlling valves/chokes or by adjusting the size of the outlet of the air mover devices 12, 120.

Although the airflow sensor 20 is shown as being adjacent to the array of air mover devices 12, 120, it will be appreciated that the airflow sensor may be located remotely provided that it gives an adequate indication of the current wind conditions at that location.

The activation sensor 22 may be omitted in other examples or may be formed by the opening sensor of the door itself.

In other examples, the array of air mover devices 12, 120 may not form an arch. For example, they may be formed as a pair of vertical uprights, and optionally, a horizontal crossbar. Further, it is not necessary for the entire arch to generate airflow. For example, the corners of the arches may not be provided with air mover devices 12, 120.

The specific form of bidirectional air multiplier utilized herein may find applications in other contexts and is not limited to being part of the active airflow inhibiting apparatus. The air multiplier may contain a first (circular) outlet and a second (circular) outlet arranged back-to-back to give airflow in both directions.

The airflow inhibiting apparatus 10 is able to inhibit airflow (generated by wind and/or temperature differentials) through a doorway (or any other entranceway) without requiring any physical obstruction. This improves customer experience and reduces power consumption of HVAC systems operating within the building.

The invention is not limited to the embodiments described herein, and may be modified or adapted without departing from the scope of the present invention as defined in the appended claims.

The invention claimed is:

1. An active airflow inhibiting apparatus for an entranceway comprising:

a structure comprising an air mover device configured to be positioned adjacent and spaced apart an entranceway of a building and defining a passage therethrough for accessing the entranceway;

an airflow sensor configured to provide an airflow output signal, the airflow output signal indicative of a speed and a direction of airflow through the entranceway or at the air mover device;

a controller connected to the air mover device and the airflow sensor;

wherein the controller is configured to receive the airflow output signal of the airflow sensor and to control an airflow output of the air mover device based on the received airflow output signal so as to generate a differential pressure across the air mover device which inhibits airflow through the entranceway; and wherein the air mover device is an air multiplier device and forms an archway.

2. An active airflow inhibiting apparatus as claimed in claim 1, wherein the air mover device includes a plurality of air mover devices and wherein the plurality of air mover devices form a plurality of arches.

3. An active airflow inhibiting apparatus as claimed in claim 2, wherein the plurality of arches are nested within one another in a single plane.

4. An active airflow inhibiting apparatus as claimed in claim 2, wherein the plurality of arches are arranged side by side.

5. An active airflow inhibiting apparatus as claimed in claim 4, wherein the plurality of air mover devices are configured to generate an area of negative pressure which entrains the airflow and/or an area of positive pressure which repels the airflow.

6. An active airflow inhibiting apparatus as claimed in claim 1, wherein the apparatus comprises a plurality of said structures and wherein each of the plurality of said structures is configured to be positioned adjacent a different entranceway of the same building.

7. An active airflow inhibiting apparatus as claimed in claim 6, wherein the controller is configured to determine a first airflow output for the air mover device of at least one of the plurality of structures, the first airflow output being dependent on a second airflow output of the other of the air mover device of the other of the at least one of the plurality of structures.

8. An active airflow inhibiting apparatus as claimed in claim 1, wherein the controller is configured to synchronize the operation of the air mover device with the opening of a door of the entranceway based on the output of an activation sensor.

9. An active airflow inhibiting apparatus as claimed in claim 8, wherein the activation sensor is located within the passage defined by the structure.

10. An active airflow inhibiting apparatus as claimed in claim 1, wherein the air mover device is configured to be located externally to the entranceway.

11. An active airflow inhibiting apparatus as claimed in claim 1, wherein the air mover device is configured to allow bidirectional airflow.

12. An active airflow inhibiting apparatus as claimed in claim 1, wherein the airflow sensor is configured to provide an output indicative of speed and direction of airflow through the entranceway at a plurality of vertical positions through the entranceway.

13. An active airflow inhibiting apparatus as claimed in claim 1, wherein the output of the one or more air mover devices is controlled by changing a fan speed setting.

14. An active airflow inhibiting apparatus as claimed in claim 1, wherein the one or more air mover devices comprise a plurality of air mover devices which are spaced around a common circle to generate a vortical airflow.

15. An active airflow inhibiting apparatus as claimed in claim 14, wherein the plurality of air mover devices are arranged so that their airflow axes lie tangential to the common circle.

* * * * *